United States Patent [19]

Holt

[11] 3,993,279

[45] Nov. 23, 1976

[54] TIE ROD SUPPORTED HANGER FOR SUSPENDED CONCRETE FORMS

[75] Inventor: Jack A. Holt, Belmont, Calif.

[73] Assignee: The Burke Company, San Mateo, Calif.

[22] Filed: Oct. 28, 1975

[21] Appl. No.: 625,958

[52] U.S. Cl. ..... 248/235; 248/228; 249/23; 249/211

[51] Int. Cl.[2] ..... E04G 17/16

[58] Field of Search ..... 248/228, 235; 249/23, 249/19, 24, 25, 219 R, 207, 211

[56] References Cited

UNITED STATES PATENTS

| | | | |
|---|---|---|---|
| 2,877,974 | 3/1959 | Estes | 248/228 |
| 2,985,936 | 5/1961 | Hillberg | 249/207 |
| 2,985,937 | 5/1961 | Hillberg | 249/207 |
| 3,782,675 | 1/1974 | Boll | 249/23 |
| 3,782,676 | 1/1974 | Boll | 249/23 |

*Primary Examiner*—J. Franklin Foss
*Attorney, Agent, or Firm*—Naylor, Neal & Uilkema

[57] ABSTRACT

A hanger comprising a pair of cast ends secured to one another by a tie rod having enlarged upset heads disposed for engagement with ends. The ends also include shoulders disposed beneath the rod for abutting engagement with an element upon which the hanger is supported. In use, the hanger is supported on a support element with the rod spanning the element and the shoulders engaged with opposite sides of the element. As thus positioned, loads imparted to the ends apply tension to the tie rod and compression to the support element.

9 Claims, 8 Drawing Figures

TIE ROD SUPPORTED HANGER FOR SUSPENDED CONCRETE FORMS

BACKGROUND OF THE INVENTION

The present invention relates to a hanger for suspending concrete forms from structural elements, such as I-beams. The invention is particularly concerned with such a hanger wherein loads transmitted thereto are balanced through means of a tie rod forming part of the hanger. In its more specific aspects, the invention is concerned with such a hanger wherein the tie rod extends through load-carrying ends forming part of the hanger and upset heads on the distal portions of the rod engage the ends.

The prior art relating to hangers for suspending concrete forms is very well developed, as exemplified by U.S. Pat. Nos. 2,985,936; 3,119,590; 3,782,675; and, 3,782,676. These patents disclose hangers adapted to suspend forms to either side of a support element and are typified by the inclusion of a rod which spans the support element and ends welded to opposite extremities of the rod. The ends typically each comprise a sheet metal member folded upon itself and formed with a lower surface having a shoulder or teeth thereon for engagement with the support element.

SUMMARY OF THE INVENTION

A key element of the present invention is the unique end which forms part of the hanger. The end comprises a body having a tie rod opening extending through an upper portion thereof; a shoulder formed on the body beneath and in generally normal relationship to the opening; and at least one suspension rod receiving opening extending through the body and so positioned that loads imparted to a rod received within the opening apply oppositely directed forces to the upper portion of the body and the shoulder. In the assembled condition of the hanger, a pair of such ends are disposed in spaced relationship to one another with a tie rod extended loosely through the tie rod openings in the ends. Enlarged upset heads are formed on the distal portions of the tie rod for abutting engagement with the ends.

A principal object of the invention is to provide a hanger for supporting concrete forms wherein the hanger is provided with cast ends secured together by a tie rod extending loosely therethrough and having upset heads at the distal portions thereof for abutting engagement with the ends.

Another and related object of the invention is to provide such a hanger wherein the ends are each provided with a compression shoulder for engagement with a support element on which the hanger is carried.

Still another and related object of the invention is to provide such a hanger wherein each of the ends carries suspension means so positioned that loads imparted thereto create a moment which applies compressive forces to the shoulder of the end and tension forces to the tie rod.

A further object of the invention is to provide a hanger for suspended concrete forms wherein the ends of the hanger are free to move so that they may be securely seated upon an element on which the hanger is supported.

Yet another object of the invention is to provide a hanger for suspended concrete forms wherein the hanger comprises a pair of spaced ends secured to one another by a tie rod extending therebetween and the rod and ends are so connected that only generally axially directed tension loads are imparted to the rod.

A further object of the invention is to provide a hanger for suspending concrete forms wherein the hanger comprises ends having a tie rod extending therebetween and the ends are secured against separation from the rods through means of hot upset heads formed on the distal portions of the rod.

The foregoing and other objects will become more apparent when viewed in light of the accompanying drawing and following detailed description.

DESCRIPTION OF THE ILLUSTRATED EMBODIMENTS

Figure 1:
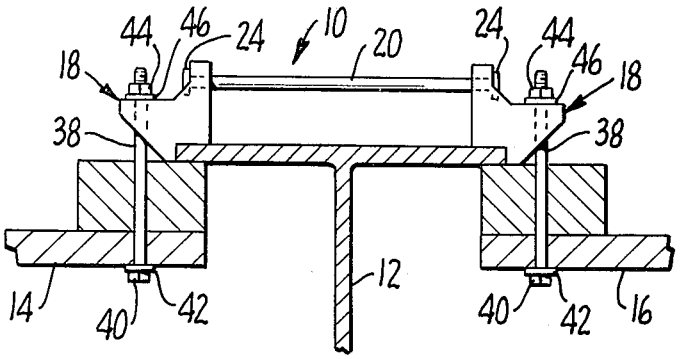
FIG. 1 is an elevational view illustrating the hanger in use in suspending a pair of concrete forms from an I-beam support element, with portions of the support element and the forms broken away and shown in section.
Figure 3:
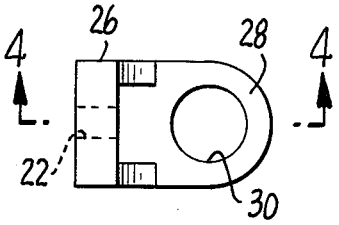
FIG. 3 is a top plan view of the end illustrated in FIG. 2.
Figure 2:
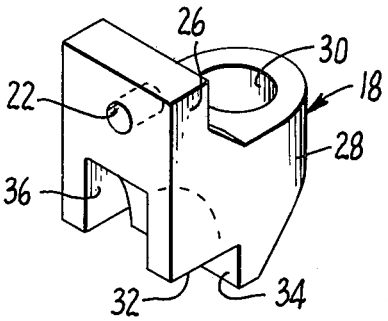
FIG. 2 is a perspective view of one of the ends of the hanger illustrated in FIG. 1.
Figure 4:
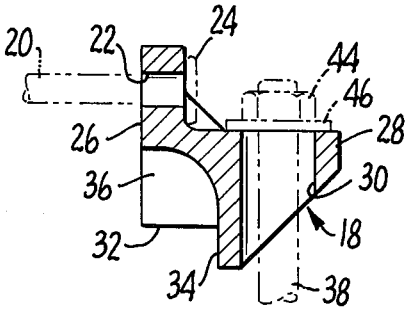
FIG. 4 is a cross-sectional view taken on the plane designated by Line 4—4 in FIG. 3, with phantom line illustrations showing the rods which engage the end.

Referring now to FIG. 1, the hanger is designated in its entirety by the numeral 10 and is shown supported on an I-beam 12 and suspending forms 14 and 16 to either side of the I-beam. The hanger 10 comprises a pair of identical ends 18 secured to one another by a tie rod 20. The tie rod 20 extends loosely through aligned openings 22 formed in the respective ends and is secured against removal from the ends through means of enlarged upset heads 24 formed on the distal portions of the rod. As may be seen from FIG. 4, the heads are disposed so as to abut against the outer surface of the ends 18.

The ends 18 are cast of any suitable material, such as cast iron or cast steel. The particular material chosen will depend upon the strength requirement of the hanger.

Each end 18 is an identical integral casting and comprises: a vertical portion 26 in which the opening 22 is formed; a laterally extending portion 28 in which a suspension rod opening 30 is formed; and an undersurface 32 having a shoulder 34 formed at one end thereof. The shoulder 34 extends in a plane generally normal to the axis of the tie rod opening 22. A recess 36 is formed in the end to conserve metal.

The tie rod 20 is formed of carbon steel and the heads 24 are hot upset at opposite distal portions of the rod. The rod 20 is chosen of a length such that, when assembled into place as illustrated in FIG. 1, the shoulders 34 of the ends secured to the rod will assume abutting engagement with the edges of the upper flange of the I-beam on which the hanger is supported. Typically, the tie rod 20 and the end 18 secured thereto would be preassembled in the shop to accommodate an I-beam or other support of a particular size.

In use, the hanger 10 is positioned on the I-beam support as illustrated in FIG. 1 and the forms 14 and 16 are suspended from the hanger through means of suspension bolts 38. The bolts 38 extend through the openings 30 and have heads and washers, 40 and 42, respectively, at their lower ends and nuts and washers, 44 and 46, respectively, at their upper ends. The washers 42 are engaged with the undersurfaces of the forms and the washers 46 are engaged with the upper surfaces of the ends. The nuts 44 are threadedly received on the suspension bolts in engagement with the washers 46.

With the hanger assembled as shown in FIG. 1, loads applied to the suspension bolts 38 impart moments to the ends 18, which moments apply tension forces to the tie rod 20 and compressive forces to the upper flange of the I-beam 12. The compressive forces are transmitted through the shoulders 34. As viewed in FIG. 1, the moment applied to the righthand end 18 is in a clockwise direction and the moment applied to the lefthand end 18 is in a counter-clockwise direction.

It should be appreciated that the rod 20 is loosely received within the openings 22. Thus, forces applied to the rod 20 through the heads 24 are substantially entirely in tension, with a minimum of any twisting.

Figure 5:
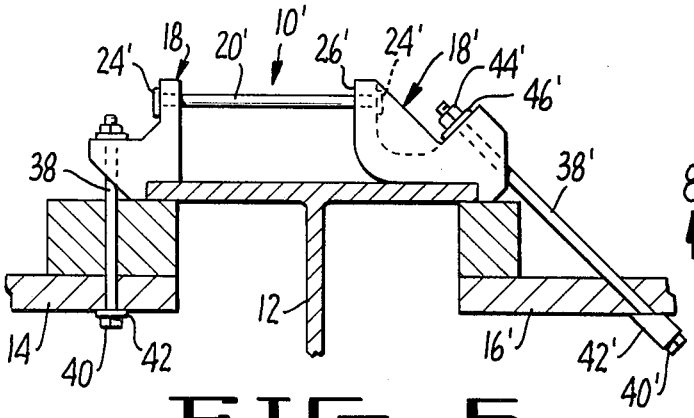
FIG. 5 is an elevational view similar to FIG. 1, illustrating the hanger with a modified end for use in suspending a cantilevered form, with the hanger shown suspending a pair of concrete forms from an I-beam support element and portions of the support element and forms broken away and shown in section.
Figure 7:
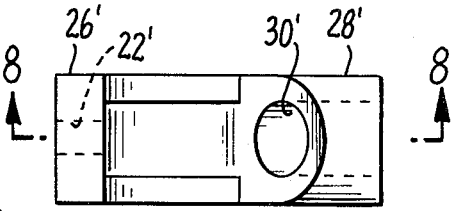
FIG. 7 is a top plan view of the modified end illustrated in FIG. 6.
Figure 6:
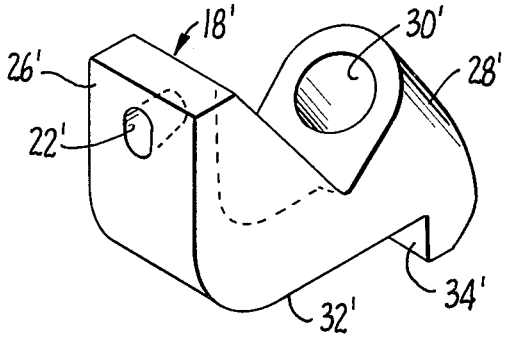
FIG. 6 is a perspective view of the modified end illustrated in FIG. 5.
Figure 8:
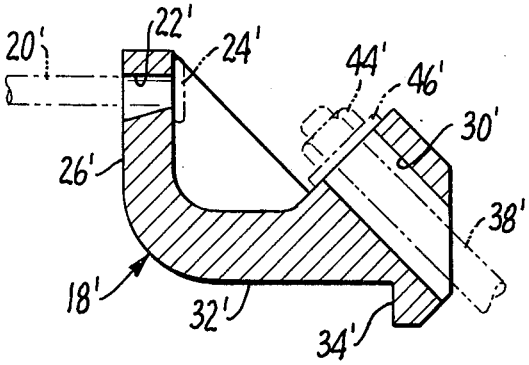
FIG. 8 is a cross-sectional view taken on the plane designated by Line 8—8 in FIG. 7, with phantom line illustrations showing the rods which engage the end.

The hanger illustrated in FIG. 5 is identical to that described with respect to FIG. 1, with the exception that the righthand end of the hanger is of a modified configuration to accommodate the suspension of a form in cantilevered fashion. The elements of the FIG. 5 embodiment which are identical to those of the FIG. 1 embodiment are designated by like numerals and the modified elements are designated by like numerals, followed by prime marks (e.g., end 18').

The ends 18 and 18' are connected through means of a tie rod 20' extending through an opening 22 in the end 18 and an opening 22' in the end 18'. Upset heads 24' are formed on the distal portions of the rod 20' for abutting engagement with the ends.

The end 18' is of integral cast construction and comprises: a vertical portion 26' in which the opening 22' is formed; a laterally extending portion 28' in which a suspension rod opening 30' is formed; and an undersurface 32' terminating at one end thereof in a shoulder 34'. The shoulder 34' extends in a plane generally normal to the axis of the tie rod opening 26'. The suspension rod opening 30' extends at an obtuse angle relative to the opening 26'. This contrasts with the end 18 wherein the suspension rod opening 30 extends generally normal to the tie rod opening 22.

As with the FIG. 1 embodiment, the hanger of the FIG. 5 embodiment, designated 10', is preassembled to accommodate a support element, such as the I-beam 12, of a particular size. In use, the hanger is supported on the support element with the shoulders 34 and 34' in engagement with opposite edges of the element. Thus, as with the FIG. 1 embodiment, the shoulders function to impart compressive forces to the support element and tension forces are imparted to the tie rod 20'.

The cantilevered form in FIG. 5 is designated by the numeral 16' and is shown suspended from the end 18' by a tie rod 38'. The rod 38' is engaged beneath the form 16' through means of a head 40' formed on the end of the rod and a spacer 42' supported on the head in engagement with the undersurface of the form. The upper end of the rod 38' extends loosely through the opening 30' and is supported on the end 18' through means of a nut 44' threadedly received on the rod and a washer 46' engaged between the nut and the upper surface of the end 18'.

When loaded, the ends 18 and 18' of the hanger 10' are subjected to moments in a manner similar to the ends 18 of the hanger 10. Thus, as viewed in FIG. 5, the end 18' is subjected to a clockwise moment and the end 18 is subjected to a counter-clockwise moment. These moments, in turn, subject the tie rod 20' to tension forces and the upper flange of the I-beam 12 to compressive forces. As with the hanger 10, the tie rod 20' of the hanger 10' is subject primarily to tension forces, since the rod is loosely received within the openings in the ends 18 and 18'.

Although only two embodiments of the hanger have been illustrated, it should be understood that the hanger may vary from these embodiments without departing from the invention. For example, both ends of the hanger may take the form of the end 18'. Accordingly, the invention is not intended to be limited to the specifics of the embodiments herein illustrated and described, but rather is defined by the accompanying claims.

What is claimed is:

1. A hanger for suspending a concrete form from a beam, said hanger comprising: a pair of ends adapted to be supported on the upper surface of the beam, each said end having an opening extending therethrough in alignment with the corresponding opening of the other end, a shoulder disposed thereon beneath said opening in opposed facing relationship to the corresponding shoulder of the other end and an undersurface disposed thereon intermediate said opening and shoulder, said shoulders and undersurfaces being engageable, respectively, with the upper surface and opposite edges of a beam upon which the hanger is supported; a tie rod extending between said ends and loosely through the aligned openings therein, said rod comprising the only connection between said ends and having enlarged heads disposed for abutting engagement with outer portions of the ends to prevent the ends from separating from the rod; and, suspension means carried by the ends so as to transmit the force of a load imparted thereto as a moment subjecting the shoulders to a compression force and the rod to a tension force.

2. A hanger, according to claim 1, wherein the heads are upset on the distal ends of the rod and each have a cross-sectional area greater than the cross-sectional area of the respective openings.

3. A hanger, according to claim 1, wherein the suspension means comprise a support opening formed in each of the ends in outwardly spaced relationship to the aligned opening therein.

4. A hanger, according to claim 3, wherein the support opening of at least one of the ends is disposed at an obtuse angle relative to the aligned opening thereof.

5. A hanger, according to claim 3, wherein the support opening of at least one of the ends is disposed in substantially normal relationship to the aligned opening thereof.

6. An end for a hanger for suspending a concrete form from a beam, said end comprising: a body having a tie rod opening extending through an upper portion thereof; a shoulder formed on said body beneath and in generally normal relationship to said opening; an undersurface formed on said body in parallel relationship to said opening intermediate said opening and shoulder; and, suspension means carried by said body so as to transmit the force of a load imparted to said means to the body as a moment applying oppositely directed forces to said upper portion and shoulder, said end being adapted to be supported on a beam with said undersurface in engagement with the upper surface of the beam, said shoulder in engagement with an edge of the beam and a tie rod extending across said beam and loosely through said opening to an enlarged head disposed to one side of the end for abutment therewith.

7. An end, according to claim 6, wherein the suspension means comprises a support opening formed in the body in outwardly spaced relationship to the tie rod opening.

8. A hanger, according to claim 7, wherein the support opening is disposed at an obtuse angle relative to the tie rod opening.

9. A hanger, according to claim 7, wherein the support opening is disposed in substantially normal relationship to the tie rod opening.

* * * * *